US009615405B2

(12) United States Patent
Clark et al.

(10) Patent No.: US 9,615,405 B2
(45) Date of Patent: Apr. 4, 2017

(54) HEAT EXCHANGE DEVICES, LIQUID ADHESIVE SYSTEMS, AND RELATED METHODS

(71) Applicant: Nordson Corporation, Westlake, OH (US)

(72) Inventors: Steven Clark, Cumming, GA (US); Wesley C. Fort, Cumming, GA (US); Mark A. Gould, Gainesville, GA (US); Leonard J. Lanier, Johns Creek, GA (US); Laurence B. Saidman, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 14/481,182

(22) Filed: Sep. 9, 2014

(65) Prior Publication Data

US 2015/0076173 A1 Mar. 19, 2015

Related U.S. Application Data

(60) Provisional application No. 61/878,254, filed on Sep. 16, 2013.

(51) Int. Cl.
*B67D 7/80* (2010.01)
*H05B 1/02* (2006.01)
(Continued)

(52) U.S. Cl.
CPC ..... *H05B 1/023* (2013.01); *B05C 11/1042* (2013.01); *F24H 1/142* (2013.01);
(Continued)

(58) Field of Classification Search
CPC ..... B05C 5/001; B05C 5/007; B05C 11/1042; H05B 1/032; H05B 3/02
(Continued)

(56) References Cited

U.S. PATENT DOCUMENTS 3,109,912 A 11/1963 Cerulli
3,310,843 A * 3/1967 Mancuso ..... B29B 13/022 222/146.1
(Continued)

FOREIGN PATENT DOCUMENTS

DE 1577630 A1 3/1970
DE 10146394 A1 5/2002
(Continued)

OTHER PUBLICATIONS

EP Application No. 14 18 4803, Extended European Search Report dated Jul. 7, 2015, 11 pages.
(Continued)

*Primary Examiner* — Lien Ngo
(74) *Attorney, Agent, or Firm* — Baker & Hostetler LLP

(57) ABSTRACT

A heat exchange device for heating liquid adhesive material to an application temperature suitable for an adhesive bonding application includes a body having an inlet configured to receive a flow of liquid adhesive material and an outlet configured to provide the liquid adhesive material to a dispensing device for the adhesive bonding application. A fluid passageway in the body connects the inlet and the outlet. The fluid passageway includes a thin slit section having a length along a fluid flow direction between the inlet and the outlet, the thin slit section further having a first dimension and a second dimension transverse to the fluid flow direction. The first dimension and the length are substantially greater than the second dimension. The heat exchange device further includes a heating element for heating the liquid adhesive material flowing through the thin slit section to the application temperature.

25 Claims, 8 Drawing Sheets

(51) Int. Cl.

| | |
|---|---|
| ***H05B 3/02*** | (2006.01) |
| ***B05C 11/10*** | (2006.01) |
| ***F24H 1/14*** | (2006.01) |
| *B05C 5/02* | (2006.01) |
| *B05B 12/10* | (2006.01) |

(52) U.S. Cl.
CPC ..... *H05B 3/02* (2013.01); *B05B 12/10* (2013.01); *B05C 5/0237* (2013.01)

(58) Field of Classification Search
USPC ..... 222/146.1, 146.2, 146.5, 504, 505
See application file for complete search history.

(56) References Cited

U.S. PATENT DOCUMENTS

| | | | | |
|---|---|---|---|---|
| 3,531,023 | A * | 9/1970 | Mercer | B29B 13/022 222/146.5 |
| 4,009,974 | A * | 3/1977 | Scholl | F04C 13/002 417/900 |
| 4,066,188 | A | 1/1978 | Scholl et al. | |
| 5,076,469 | A | 12/1991 | Pleuse et al. | |
| 5,539,853 | A | 7/1996 | Jamaluddin et al. | |
| 7,082,262 | B2 | 7/2006 | Clark et al. | |
| 7,190,893 | B2 * | 3/2007 | Kuebler | B60S 1/488 392/485 |
| 7,221,859 | B2 | 5/2007 | Stumphauzer et al. | |
| 7,614,525 | B2 | 11/2009 | Saidman | |
| 7,626,143 | B2 | 12/2009 | Miller | |
| 8,309,874 | B2 | 11/2012 | Hou et al. | |
| 9,169,088 | B2 * | 10/2015 | Chau | B04C 5/13 |
| 9,338,828 | B2 | 5/2016 | McGuffey | |
| 2001/0046551 | A1 | 11/2001 | Falck et al. | |
| 2005/0230423 | A1 | 10/2005 | Riney et al. | |
| 2006/0157517 | A1 * | 7/2006 | Fiske | B05C 5/001 222/504 |
| 2007/0166018 | A1 | 7/2007 | Stumphauzer et al. | |
| 2009/0101669 | A1 * | 4/2009 | Hassler, Jr. | B05C 5/001 222/1 |
| 2009/0285983 | A1 | 11/2009 | Baldauf et al. | |
| 2013/0112709 | A1 | 5/2013 | Ross et al. | |
| 2014/0117049 | A1 | 5/2014 | Varga | |

FOREIGN PATENT DOCUMENTS

| | | | |
|---|---|---|---|
| DE | 102005005924 | A1 | 1/2007 |
| DE | 202011050452 | U1 | 3/2012 |
| EP | 1588771 | A2 | 10/2005 |
| WO | 9738798 | A1 | 10/1997 |

OTHER PUBLICATIONS

European Patent Office, Partial European Search Report in EP Application Serial No. 14184803.6, Mar. 6, 2015 (6 pages).

R.G. Watts et al., American Society of Mechanical Engineers, Feedback Control Optimization of a Single Fluid Heat Exchanger, Article, 10 pgs., 1966.

Frank P. Incropera et al., Fundamentals of Heat and Mass Transfer, Sixth Edition, Article, pp. 501, 502, 413, 519, undated.

International Application No. PCT/US2016/020614: International Search Report and The Written Opinion dated Jun. 27, 2016, 13 pages.

* cited by examiner

HEAT EXCHANGE DEVICES, LIQUID ADHESIVE SYSTEMS, AND RELATED METHODS

CROSS-REFERENCE TO RELATED APPLICATION

This application claims the priority of U.S. Provisional Patent Application Ser. No. 61/878,254, filed on Sep. 16, 2013, the disclosure of which is incorporated by reference herein.

FIELD OF THE INVENTION

The present invention generally relates to liquid adhesive systems, and more particularly to heat exchange devices for heating liquid adhesive materials to application temperatures.

BACKGROUND

Thermally insulative properties of hot melt adhesive materials can present challenges relating to effectively transferring heat to a quantity of hot melt adhesive material. In particular, the liquid hot melt adhesive material tends to have higher temperatures in regions near a heater. But because hot melt adhesive materials are somewhat thermally insulative, heat imparted by the heater is not readily transferred through the hot melt adhesive material, and as a result, the liquid adhesive material that is distant from the heater tends to have lower temperatures. In addition, liquid adhesive materials do not generally flow in a manner that encourages heat distribution.

SUMMARY

Embodiments of the invention are directed to heat exchange devices, adhesive systems, and related methods. In particular, the heat exchange devices are configured to heat a liquid adhesive material to an application temperature suitable for an adhesive bonding application. The heat exchange devices are coupled, either directly or indirectly, with a dispensing device. The heat exchange devices include fluid passageways having thin slit sections through which the liquid adhesive material is directed and heated. Advantageously, the temperature of liquid adhesive materials can be maintained at lower temperatures before they reach the heat exchange devices, thereby reducing the energy consumed in heating the liquid adhesive material. Also advantageously, by maintaining the liquid adhesive materials at lower temperatures, the degradation effects of elevated temperatures may be avoided or lessened. In addition, the shape of the fluid passageways, and their thin slit sections, extending through the heat exchange devices tends to encourage even and thorough heating of the liquid adhesive material.

According to one embodiment of the invention, a heat exchange device is provided for heating liquid adhesive material to an application temperature suitable for an adhesive bonding application. The heat exchange device includes a body having an inlet configured to receive a flow of liquid adhesive material and an outlet configured to provide the liquid adhesive material to a dispensing device for the adhesive bonding application. The heat exchange device further includes a fluid passageway defined in the body connecting the inlet and the outlet and configured to receive the flow of liquid adhesive material. The fluid passageway includes a thin slit section having a length along a fluid flow direction between the inlet and the outlet, the thin slit section further having a first dimension and a second dimension transverse to the fluid flow direction. The first dimension and the length of the thin slit section are substantially greater than the second dimension. The heat exchange further includes a heating element thermally coupled with the body and configured for heating the liquid adhesive material flowing through the thin slit section to the application temperature.

According to another embodiment of the invention, a liquid adhesive system is provided and includes an adhesive supply configured to provide a supply of liquid adhesive material and a dispensing device configured for dispensing the liquid adhesive material in an adhesive bonding application. The liquid adhesive system further includes a heat exchange device coupled with the adhesive supply and the dispensing device and configured for heating the liquid adhesive material from the adhesive supply to an application temperature suitable for the adhesive bonding application by the dispensing device. The liquid adhesive system further includes a controller operatively coupled with the heat exchange device and the adhesive supply. The controller is configured to operate the heat exchange device so as to heat the liquid adhesive material to the application temperature and to operate the adhesive supply to maintain the liquid adhesive material at a temperature below the application temperature, such that the liquid adhesive material is not suitable for the adhesive bonding application before it is heated to the application temperature in the heat exchange device.

According to another embodiment of the invention, a method is provided for dispensing liquid adhesive material for an adhesive bonding application. The method includes directing liquid adhesive material from an adhesive supply to a heat exchange device and through a thin slit section of a fluid passageway in the heat exchange device. The method further includes heating the liquid adhesive material in the fluid passageway of the heat exchange device to an application temperature suitable for the adhesive bonding application. The liquid adhesive material is maintained at temperatures below the application temperature before it is heated in the heat exchange device such that the liquid adhesive material is not suitable for the adhesive bonding application before it is heated in the heat exchange device. The method further includes directing the liquid adhesive material from the heat exchange device to a dispensing device, and dispensing the liquid adhesive material using the dispensing device.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Referring generally to the figures, exemplary heat exchange devices are shown that are useful for heating liquid adhesive material before the liquid adhesive material is dispensed by a dispensing device. In particular, the heat exchange devices are configured to heat liquid adhesive material to an application temperature suitable for an adhesive bonding application. The heat exchange devices include fluid passageways having thin slit sections through which the liquid adhesive material is directed and heated. The thin slit sections present regions where the liquid adhesive material is quickly and thoroughly heated. As will become apparent from the following description, these heat exchange devices allow liquid adhesive material to be maintained at lower temperatures before being heated by the heat exchange devices to the application temperature for the adhesive bonding application.

As used herein, the term liquid adhesive material refers to at least two general types of liquid adhesive material that are heated before being used for an adhesive bonding application. The first type is created when solid or semi-solid unmelted hot melt adhesive material is heated and melted to form a liquid hot melt adhesive material. The second type is liquid, or generally liquid-like so as to flow, at ambient conditions.

Figure 1:
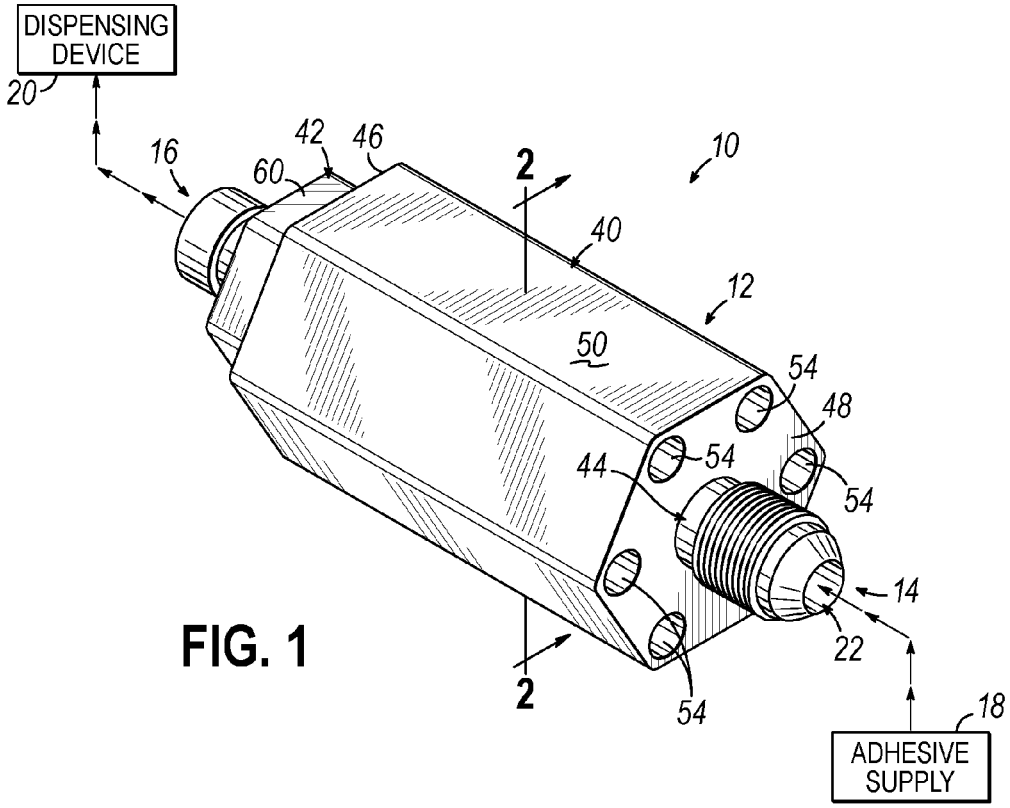
FIG. 1 is an isometric view showing a heat exchange device constructed according to an embodiment of the invention and configured to heat liquid adhesive material to an application temperature suitable for an adhesive bonding application.
Figure 3:
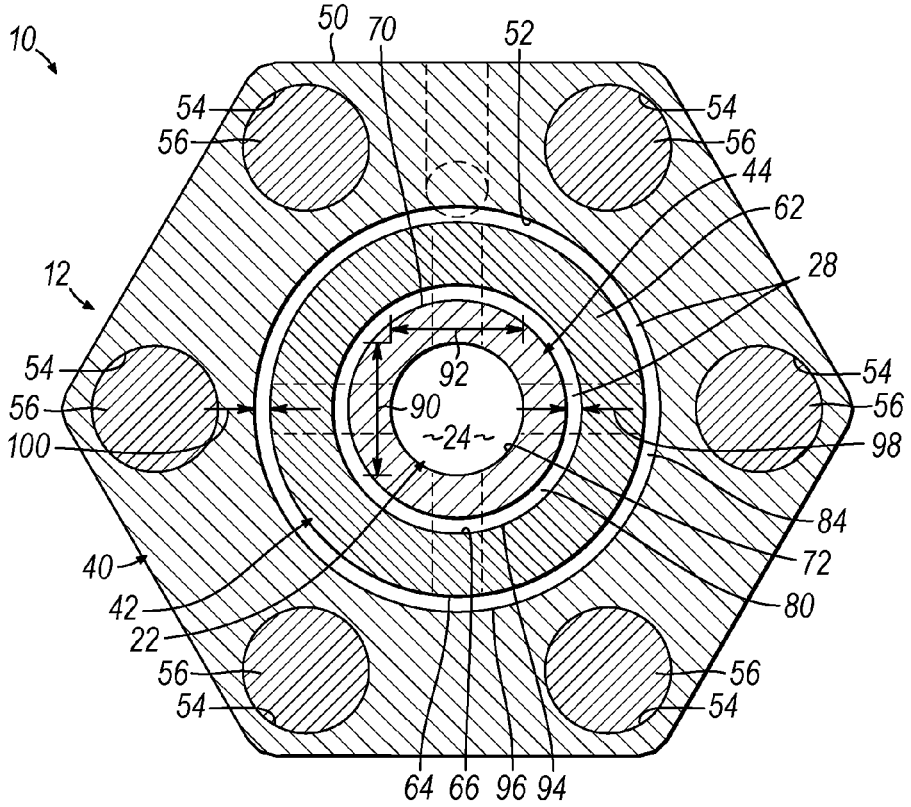
FIG. 3 is a schematic cross sectional view taken along line 3-3 of FIG. 2 and further showing interior features of the heat exchange device of FIG. 1, including a thin slit section of the fluid passageway.
Figure 2:
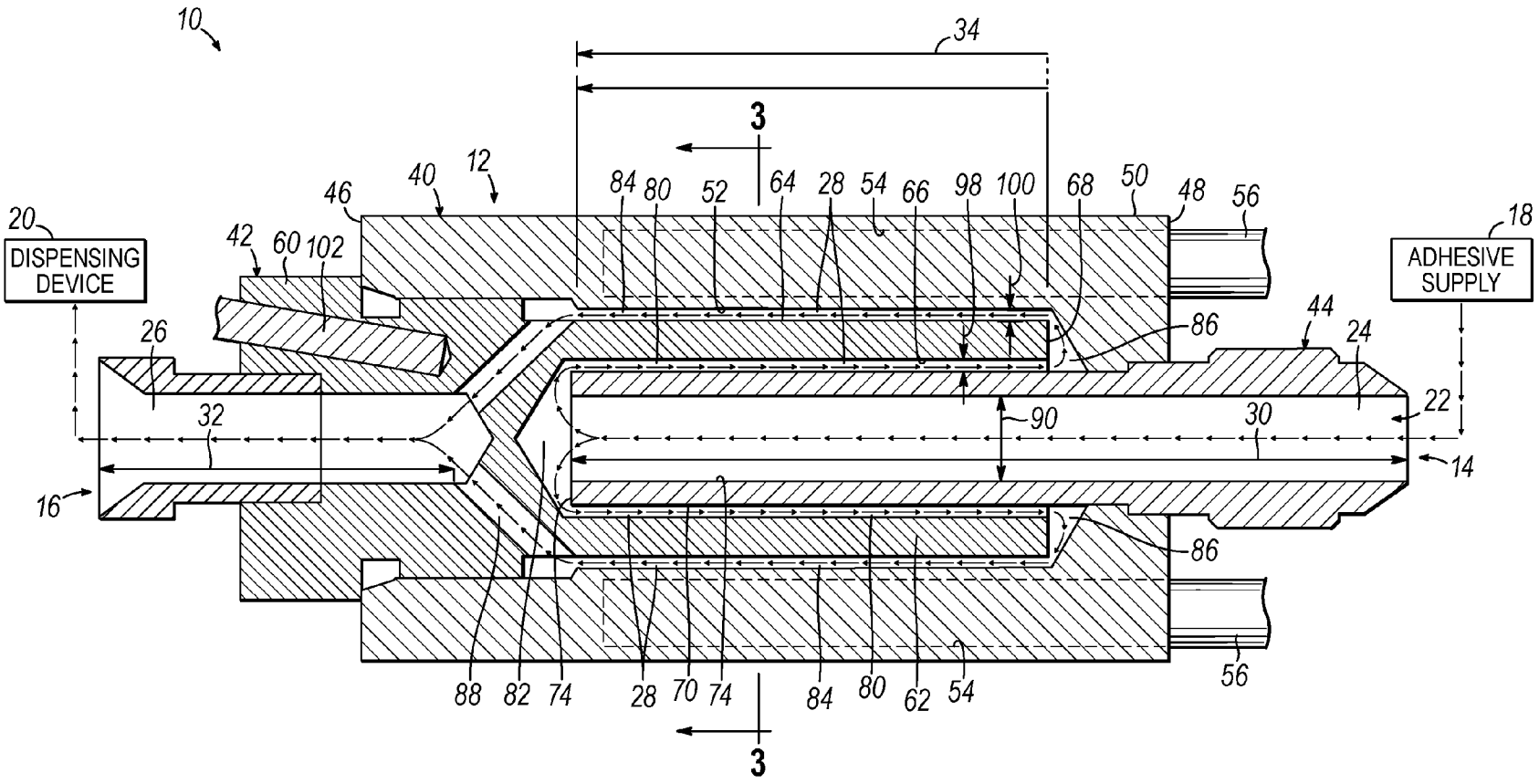
FIG. 2 is a schematic cross sectional view taken along line 2-2 of FIG. 1 and showing interior features of the heat exchange device of FIG. 1, including an inlet, an outlet, and a fluid passageway therebetween.
Figure 4:
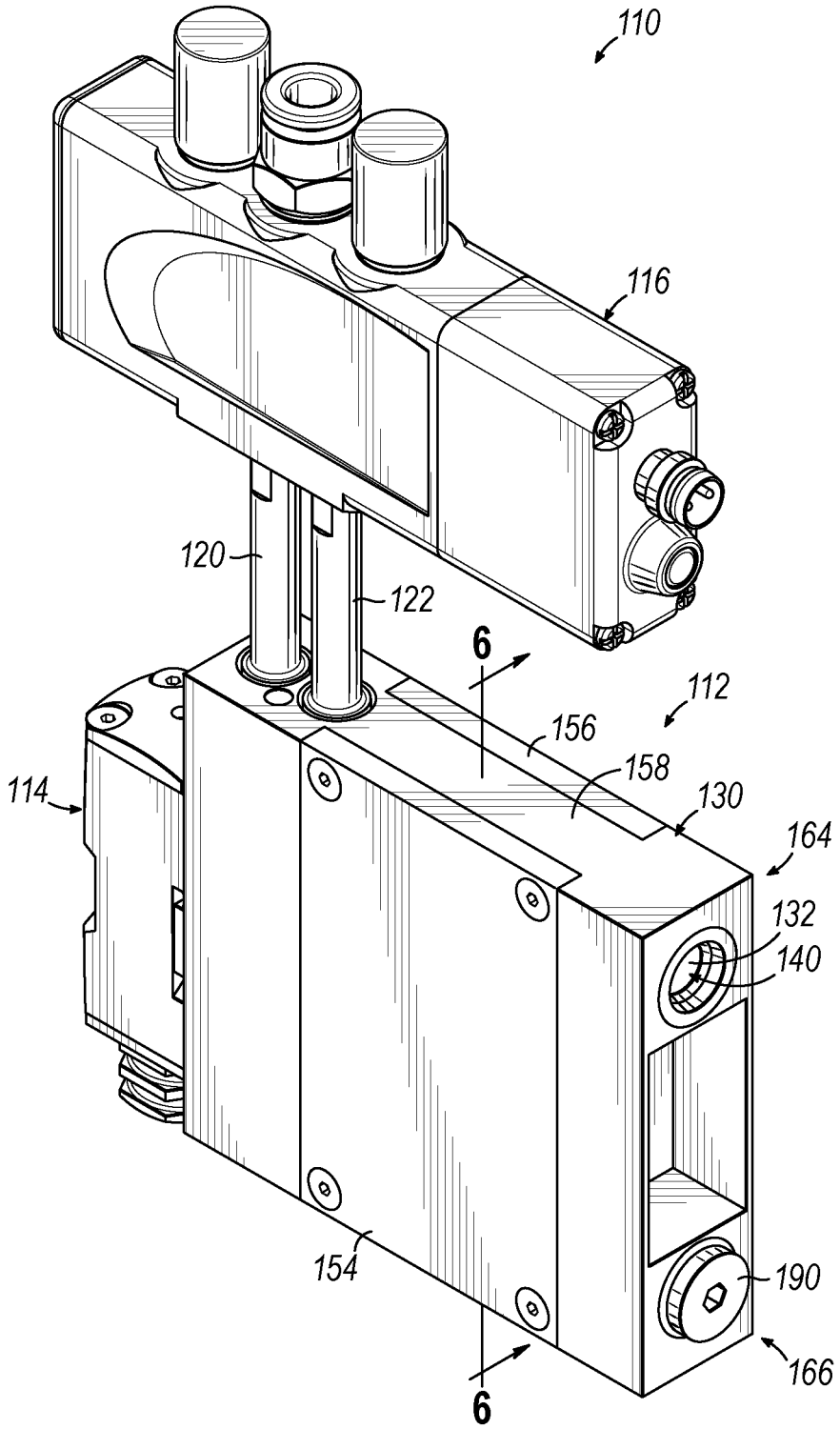
FIG. 4 is an isometric view showing an assembly constructed according to another embodiment of the invention and including a heat exchange device, a dispensing device, and a control device for controlling the dispensing device. The heat exchange device is configured to heat liquid adhesive material to an application temperature suitable for an adhesive bonding application.
Figure 5:
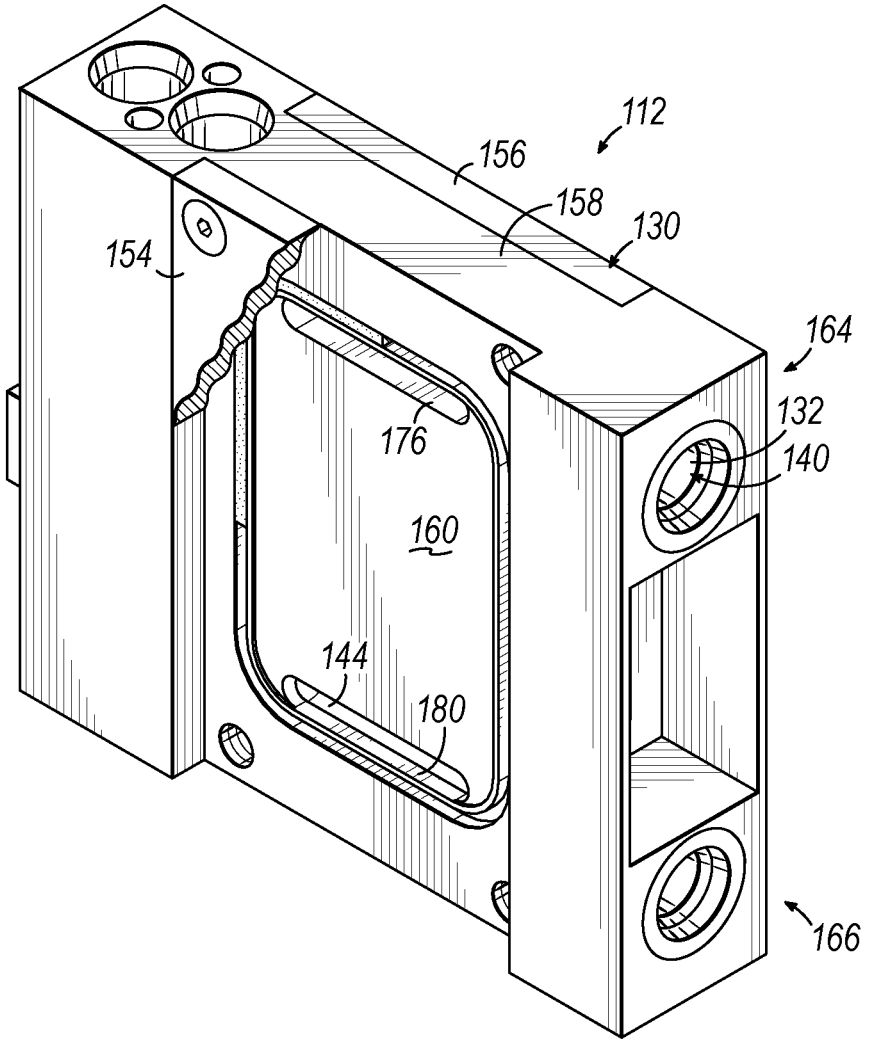
FIG. 5 is an isometric view showing the heat exchange device of FIG. 4 with outer walls thereof removed.

Beginning with FIGS. 1-3, a heat exchange device 10 generally includes a body 12 having an inlet 14 and an outlet 16. The inlet 14 is configured to receive a flow of liquid adhesive material, such as from an adhesive supply 18, which provides the liquid adhesive material. The adhesive supply 18 generally includes components upstream from the heat exchange device 10, and can include, for example, any or all of a tank, grid, reservoir, manifold, and hoses. The adhesive supply 18 may optionally heat the liquid adhesive material. The outlet 16 of the body 12 of the heat exchange device 10 is configured to provide the liquid adhesive material heated in the heat exchange device 10 to a dispensing device 20.

A fluid passageway 22 is defined in the body 12 and connects the inlet 14 and the outlet 16. The heat exchange device 10 is configured to heat liquid adhesive material that flows through the fluid passageway 22. The fluid passageway 22 includes an inlet section 24, an outlet section 26, and a thin slit section 28 located between the inlet section 24 and the outlet section 26. All of the sections 24, 26, 28 have lengths along a fluid flow direction between the inlet 14 and the outlet 16. Particularly, the inlet section 24 has a length 30, the outlet section 26 has a length 32, and the thin slit section 28 has a length 34. Based on engineering heat transfer principles, it will be understood that the thin slit section 28 will have the highest Nusselt number or numbers, compared with the other fluid flow sections.

In the embodiment shown, the body 12 is comprised of generally concentrically arranged body segments, including a first body segment 40, a second body segment 42, and a third body segment 44. Referring to FIGS. 2 and 3, the first body segment 40 is generally radially outside both the second and third body segments 42, 44. The second body segment 42 is received within the first body segment 40 near a first end 46 thereof. Thus, the second body segment 42 is generally radially inside the first body segment 40.

The third body segment 44 is received within the first body segment 40 near a second end 48 thereof. The third body segment 44 is also received within the second body segment 42. Thus, the third body segment 44 is generally radially inside the first and second body segments 40, 42.

The first body segment 40 includes an outer surface 50 having a generally hexagonal shape. It will be appreciated that other shape configurations are possible for the body 12, including for the first body segment 40. The first body segment 40 also includes an inner surface 52 that is contoured to engage with the second and third body segments 42, 44, as shown. Sockets 54 are formed in the first body segment 40 between the outer surface 50 and the inner surface 52 for receiving heating elements 56. The heating elements 56 are thereby thermally coupled with the body 12. In the embodiment shown, the first body segment 40 includes six sockets 54 for receiving up to six heating elements 56, although different numbers of sockets and heating elements could also be used. It will be appreciated that other configurations are possible for thermally coupling the heating elements 56 with the body 12. The body 12, including its body segments 40, 42, 44, may be formed of a heat conductive material so that heat generated by the heating elements 56 is transferred through the body 12 to the liquid adhesive material flowing through the fluid passageway 22.

The second body segment 42 includes a base portion 60 positioned near the first end 46 of the first body segment 40. The outlet 16 is in the base portion 60. Also, the outlet section 26 of the fluid passageway 22 is defined generally within the base portion 60.

The second body segment 42 also includes an extension portion 62 extending from the base portion 60 toward the second end 48 of the first body segment 40. The extension portion 62 has a generally open cylindrical shape and includes an outer surface 64 and an inner surface 66. The extension portion 62 terminates at a distal end 68.

The third body segment 44 has a generally open cylindrical shape and includes an outer surface 70 and an inner surface 72. The third body segment 44 terminates at a distal end 74. The inlet section 24 of the fluid passageway 22 is defined generally within the inner surface 72 of the third body segment 44.

The thin slit section 28 of the fluid passageway 22 is defined partially between the third body segment 44 and the second body segment 42, and partially between the second body segment 42 and the first body segment 40. In particular, a first leg 80 of the thin slit section 28 is defined between the outer surface 70 of the third body segment 44 and the inner surface 66 of the second body segment 42. A transition section 82 connects the inlet section 24 with the first leg 80 near the distal end 74 of the third body segment 44.

A second leg 84 of the thin slit section 28 is defined between the outer surface 64 of the second body segment 42 and the inner surface 52 of the first body segment 40. A transition section 86 connects the first leg 80 and the second leg 84 of the thin slit section 28 near the distal end 68 of the second body segment 42.

The second leg 84 of the thin slit section 28 is connected with the outlet section 26 of the fluid passageway 22 by a transition section 88. The thin slit section length 34, therefore, generally includes the length of the first leg 80 and the second leg 84.

The fluid passageway 22 thereby follows a winding path within the body 12. This increases the length of the fluid passageway 22 for the given size of the body 12, and may serve to somewhat mix the liquid adhesive material flowing through the fluid passageway 22. Also, by increasing the length of the fluid passageway 22, the dwell time for the liquid adhesive material in the fluid passageway 22 may be increased.

Liquid adhesive material flows through the heat exchange device 10 as follows. First, the liquid adhesive material enters the inlet 14 and flows in the inlet section 24 of the fluid passageway 22 in a fluid flow direction toward the outlet 16. The liquid adhesive material flows from the inlet section 24 through the transition section 82 and into the first leg 80 of the thin slit section 28. The liquid adhesive material flows from the first leg 80 through the transition section 86 and into the second leg 84 of the thin slit section 28. The liquid adhesive material flows from the second leg 84 through the transition section 88 and into the outlet section 26. Finally, the liquid adhesive material flows through the outlet section 26 and exits through the outlet 16. The liquid adhesive material is heated as it flows through the fluid passageway 22, including the thin slit section 28.

Referring especially to FIG. 3, features of the thin slit section 28 are further described. Again, the thin slit section 28 includes a first leg 80 and a second leg 84. FIG. 3 shows a cross sectional view transverse to the fluid flow direction in the fluid passageway 22. As shown in that figure, the first leg 80 of the thin slit section 28 is defined between the outer surface 70 of the third body segment 44 and the inner surface 66 of the second body segment 42. Also, the second leg 84 of the thin slit section 28 is defined between the outer surface 64 of the second body segment 42 and the inner surface 52 of the first body segment 40.

The inlet section 24 has a profile transverse to the fluid flow direction having a generally circular shape. That profile is characterized by a height dimension 90 and a width dimension 92. Because the profile of the inlet section 24 is generally circular, the height and width dimensions 90, 92 are generally equal. Other shape profiles for the inlet section 24 are also possible, so long as the height and width dimensions 90, 92 are equal, or generally equal (such as would be the case with square, rectangular, or oval-shaped profiles, for example).

Although the outlet section 26 is not shown in FIG. 3, it is similar to the inlet section 24 in that it has a profile transverse to the fluid flow direction having a generally circular shape. The outlet section 26 is also characterized by a height dimension and a width dimension that are equal, or generally equal, as discussed above with respect to the inlet section 24.

FIG. 3 also shows that the first and second legs 80, 84 of the thin slit section 28 have profiles transverse to the fluid flow direction having ring shapes. The ring shapes are characterized by first dimensions 94, 96, respectively, which are the circumferences of the ring shapes of the first and second legs 80, 84. The ring shapes are also characterized by second dimensions 98, 100, respectively, which are the radial thicknesses of the ring shapes of the first and second legs 80, 84. The circumferences 94, 96 of the ring shapes are substantially greater than the radial thicknesses 98, 100. In addition, the thin slit section length 34, and the length of the first and second legs 80, 84 thereof, are all substantially greater than the radial thicknesses 98, 100.

The thin slit section 28 of the fluid passageway 22 presents a region in the heat exchange device 10 where a large surface area of the body 12 contacts a relatively small volume of liquid adhesive material. Under such conditions, heat is quickly and effectively transferred from the body 12 to the liquid adhesive material. In particular, heat transferred from the body 12 spreads across the entire quantity of liquid adhesive material flowing through the radial thicknesses 98, 100 of the first and second legs 80, 84, respectively, of the thin slit section 28. Thereby, the liquid adhesive material flowing in the first and second legs 80, 84 is evenly and thoroughly heated. As a consequence, localized and uneven heating of liquid adhesive material is unlikely, and the heat exchange device 10 provides advantageous control over heating liquid adhesive material.

As shown in FIG. 2, the heat exchange device 10 can include a temperature sensor 102 for measuring the temperature of the liquid adhesive material flowing through the fluid passageway 22, and in particular exiting the outlet 16. In the embodiment shown, the temperature sensor 102 is coupled with the body 12 in the second body segment 42 thereof. Advantageously, the temperature sensor 102 is positioned at a location to measure the temperature of the liquid adhesive material after it has been at least partially heated by the heat exchange device 10. For example, and as shown, the temperature sensor 102 is located near the transition section 88 which connects the second leg 84 of the thin slit section 28 with the outlet section 26. Liquid adhesive material is at least partially, if not substantially, heated when it reaches the transition section 88. It will also be noted that the temperature sensor 102 is closer to the fluid passageway 22 (at its closest point) than to either one of the heating elements 56. As another optional definition of the proximity of the temperature sensor 102 to the adhesive fluid flow path or fluid passageway 22, the shortest distance from the sensor 102 to the fluid passageway 22 should be less than 1/10 of the total length of the fluid passageway 22, and preferably, less than 1/20 of the total length of the fluid passageway 22. And as discussed above, the thin slit section 28 encourages even and thorough heating of liquid adhesive material flowing through the fluid passageway 22. As a result, a temperature measurement taken by the temperature sensor 102 accurately reflects the temperature of the liquid adhesive material after it has been at least partially heated by the heat exchange device 10. It will be appreciated that the temperature sensor 102 could also be positioned at other suitable locations.

In some embodiments, the temperature sensor 102 is positioned at a location such that the heat exchange device 10 can quickly respond to measured temperature values. Particularly, the temperature sensor 102 can be positioned to measure the temperature of liquid adhesive material flowing in the fluid passageway 22 at a location where (1) the amount of time it takes the liquid adhesive material to flow from that location to the outlet 16 is approximately equal to (2) the amount of time it takes the heat exchange device 10 to change the temperature of the liquid adhesive material flowing in the fluid passageway 22 to the desired temperature.

Referring next to FIGS. 4-8, an assembly 110 includes a heat exchange device 112, a dispensing device 114, and a control device 116 for controlling the dispensing device 114. As shown, the heat exchange device 112 is directly coupled with the dispensing device 114. The dispensing device 114 includes an internal valve mechanism for controlling the flow of liquid adhesive material out of a dispensing opening 118. The valve mechanism of the dispensing device 114 is operatively coupled with air conduits 120, 122 of the control device 116 for controlling the operation of the valve mechanism.

The heat exchange device 112 includes a body 130 having an inlet 132 and an outlet 134. The inlet 132 is configured to receive a flow of liquid adhesive material, such as from an adhesive supply 136, which provides the liquid adhesive material. The adhesive supply 136 generally includes components upstream from the heat exchange device 112, and can include, for example, any or all of a tank, grid, reservoir, manifold, and hoses. The adhesive supply 136 may optionally heat the liquid adhesive material. The outlet 134 of the heat exchange device 112 is directly coupled with an inlet of the dispensing device 114 and is configured to provide the liquid adhesive material heated in the heat exchange device 112 directly to the dispensing device 114 for dispensing through the dispensing opening 118.

A fluid passageway 140 is defined in the body 130 and connects the inlet 132 and the outlet 134. The heat exchange device 112 is configured to heat the liquid adhesive material flowing through the fluid passageway 140. The fluid passageway 140 includes an inlet section 142, an outlet section 144, and thin slit section 146 between the inlet and outlet sections 142, 144. All of the sections 142, 144, 146 have lengths along a fluid flow direction between the inlet 132 and the outlet 134. Particularly, the inlet section 142 has a length 148, the outlet section 144 has a length 150, and the thin slit section 146 has a length 152.

The body 130 includes a first outer wall 154 and a second outer wall 156 generally opposed from the first outer wall 154. The body 130 also includes a block 158 positioned between and spaced from the first and second outer walls 154, 156. The block 158 includes outer surfaces 160, 162 facing the first and second outer walls 154, 156, respectively.

The body 130 also includes a head 164 generally opposed from a base 166, and the block 158 is positioned generally between the head 164 and the base 166. The inlet 132 and the inlet section 142 of the fluid passageway 140 are generally in the head 164. The outlet 134 and the outlet section 144 of the fluid passageway 140 are generally in the base 166.

Sockets 168 are formed in the block 158 between the outer surfaces 160, 162 for receiving heating elements 170. The heating elements 170 are thereby thermally coupled with the body 130. In the embodiment shown, the block 158 includes two sockets 168 for receiving up to two heating elements 170, although different numbers of sockets and heating elements could also be used. It will be appreciated that other configurations are possible for thermally coupling the heating elements 170 with the body 130.

Like the body 12, the body 130 may be formed of a heat conductive material so that heat generated by the heating elements 170 in the sockets 168 is transferred through the body 130 to the liquid adhesive material flowing through the fluid passageway 140.

The thin slit section 146 of the fluid passageway 140 is defined between the block 158 and at least one of, or both of, the first and second outer walls 154, 156. In particular, a first leg 172 of the thin slit section 146 is defined between the first outer wall 154 and the outer surface 160 of the block 158. A second leg 174 of the thin slit section 146 is defined between the second outer wall 156 and the outer surface 162 of the block 158. The first and second legs 172, 174 represent alternative routes along the fluid passageway 140, and so the thin slit section length 152 is generally equal to the length of either of the first and second legs 172, 174.

A transition section 176 connects the inlet section 142 of the fluid passageway 140 with the first leg 172 of the thin slit section 146. Similarly, a transition section 178 connects the inlet section 142 of the fluid passageway with the second leg 174 of the thin slit section 146. The transition sections 176, 178 are generally positioned within the head 164 of the body 130.

Toward the other end of the body 130, a transition section 180 connects the first leg 172 of the thin slit section 146 with the outlet section 144 of the fluid passageway 140. Similarly, a transition section 182 connects the second leg 174 of the thin slit section 146 with the outlet section 144 of the fluid passageway 140. The transition sections 180, 182 are generally positioned within the base 166 of the body 130.

Flow of liquid adhesive material through the transition sections 176, 178 (into the thin slit section 146) and through the transition sections 180, 182 (out of the thin slit section) may serve to somewhat mix the liquid adhesive material flowing through the fluid passageway 140.

Figure 6:
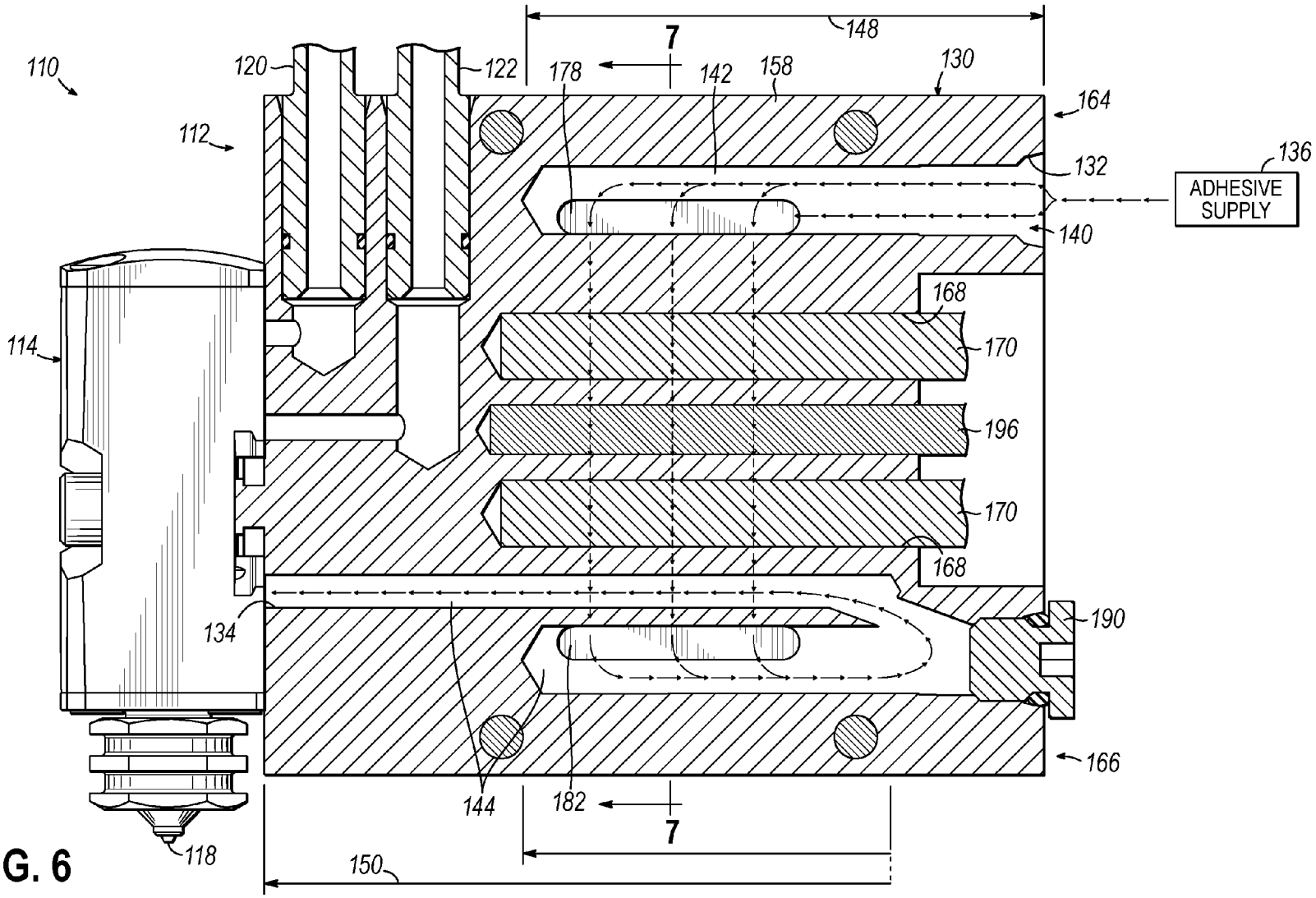
FIG. 6 is a schematic cross sectional view showing features of the assembly of FIG. 4, including an inlet and an outlet in the heat exchange device, and a fluid passageway therebetween.

Optionally, and as shown in FIG. 6, the heat exchange device 112 can include a filter 190 for filtering the liquid adhesive material flowing through the fluid passageway 140. The filter 190 is coupled with the outlet section 144 of the fluid passageway 140 for filtering liquid adhesive material flowing therein.

Liquid adhesive material flows through the heat exchange device 112 as follows. First, the liquid adhesive material enters the inlet 132 and flows in the inlet section 142 of the fluid passageway 140 in a fluid flow direction toward the outlet 134. The liquid adhesive material flows from the inlet section 142 through either (1) the transition section 176 into the first leg 172 of the thin slit section 146, or (2) the transition section 178 into the second leg 174 of the thin slit section 146. The liquid adhesive material flows from the first and second legs 172, 174 through the transition sections 180, 182 and into outlet section 144 of the fluid passageway 140. The liquid adhesive material flows in the outlet section 144 and through the filter 190, if included. Finally, the liquid adhesive material flows through the outlet section 144 and exits through the outlet 134 and is directly received in the inlet of the dispensing device 114. The liquid adhesive material is heated as it flows through the fluid passageway 140, including in the thin slit section 146.

The thin slit section 146 of the fluid passageway 140 presents a region in the heat exchange device 112 where a large surface area of the body 130 contacts a relatively small volume of liquid adhesive material. Under such conditions, and as discussed above, heat is quickly and effectively transferred from the body 130 to the liquid adhesive material. In particular, heat transferred from the body 130 spreads across the entire quantity of liquid adhesive material flowing through the first and second legs 172, 174 of the thin slit section 146. Thereby, the liquid adhesive material flowing in the first and second legs 172, 174 is evenly and thoroughly heated. As a consequence, localized and uneven heating of liquid adhesive material is unlikely, and the heat exchange device 112 provides advantageous control over heating liquid adhesive material.

Figure 7:
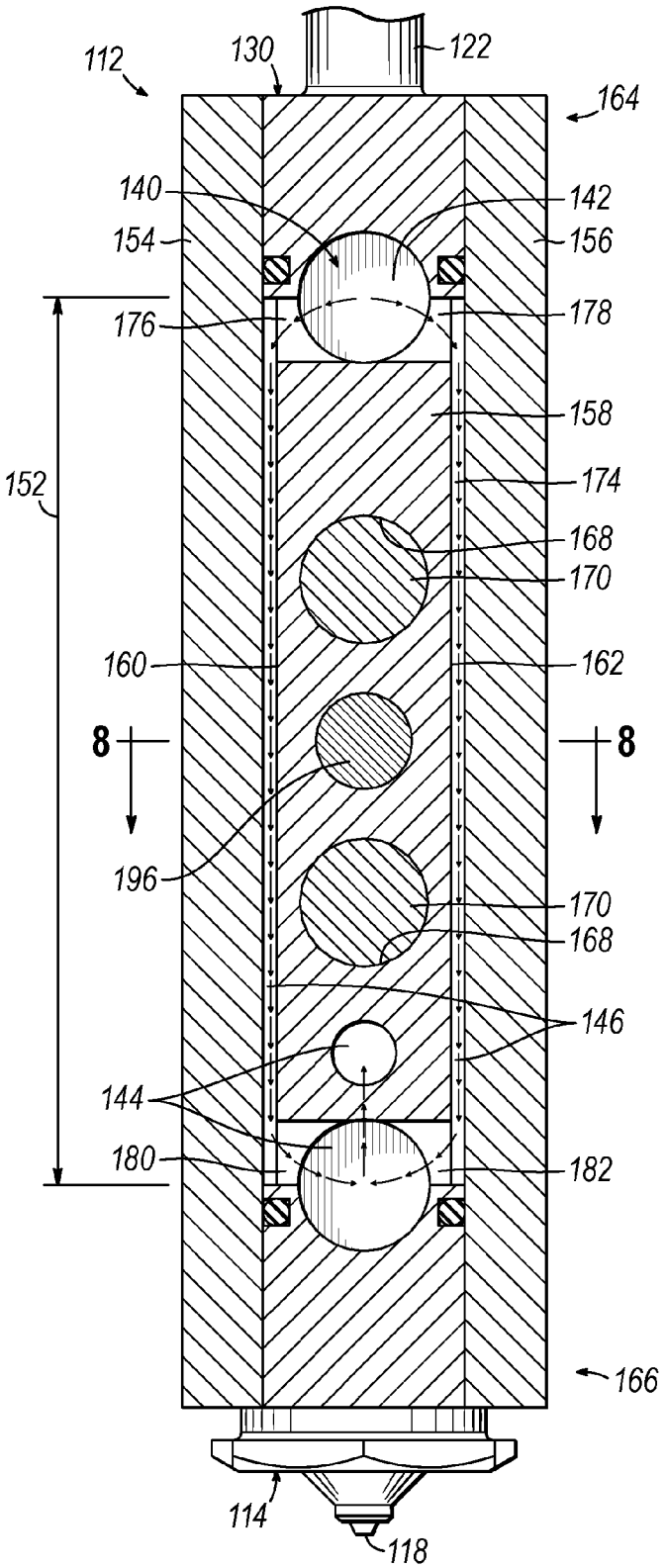
FIG. 7 is a schematic cross sectional view taken along line 7-7 of FIG. 6 and showing interior features of the heat exchange device of FIG. 4, including a thin slit section of the fluid passageway.

As shown in FIGS. 6 and 7, the assembly 110 or the heat exchange device 112 can include a temperature sensor 196 for measuring the temperature of the liquid adhesive material flowing through the fluid passageway 140, and in particular exiting the outlet 134. In the embodiment shown, the temperature sensor 196 is coupled with the body 130 in the block 158 thereof generally between the heating elements 170. Advantageously, the temperature sensor 196 is positioned at a location to measure the temperature of the liquid adhesive material after it has been at least partially heated by the heat exchange device 112. For example, and as shown, the temperature sensor 196 is located near the first and second legs 172, 174 of the thin slit section 146 generally medially between the inlet section 142 and the outlet section 144. Liquid adhesive material is at least partially, if not substantially, heated when it reaches this location. And as discussed above, the thin slit section 146 encourages even and thorough heating of liquid adhesive material flowing through the fluid passageway 140. As a result, a temperature measurement taken by the temperature sensor 196 accurately reflects the temperature of the liquid adhesive material after it has been at least partially heated by the heat exchange device 112. It will be appreciated that the temperature sensor 196 could also be positioned at other suitable locations.

In some embodiments, the temperature sensor 196 is positioned at a location such that the heat exchange device 112 can quickly respond to measured temperature values. Particularly, the temperature sensor 196 can be positioned to measure the temperature of liquid adhesive material flowing in the fluid passageway 140 at a location where (1) the amount of time it takes the liquid adhesive material to flow from that location to the outlet 134 is approximately equal to (2) the amount of time it takes the heat exchange device 112 to change the temperature of the liquid adhesive material flowing in the fluid passageway 140 to the desired temperature.

Figure 8:
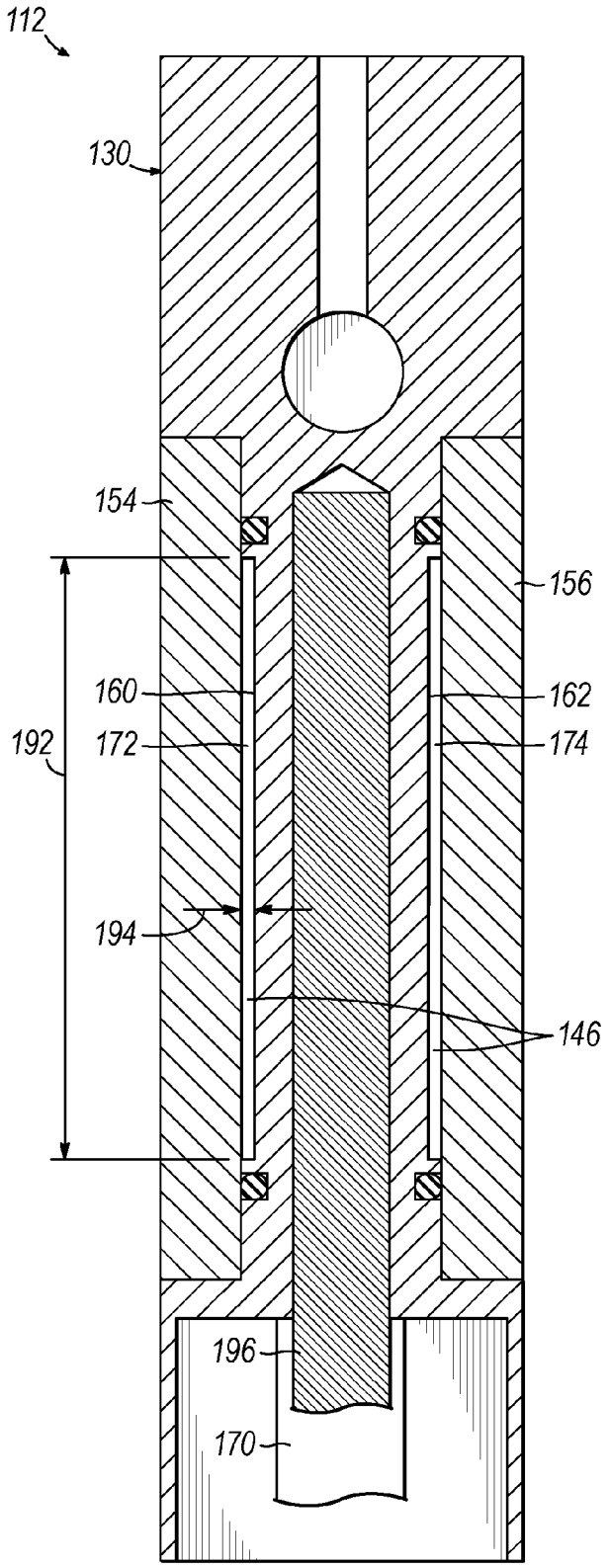
FIG. 8 is a schematic cross sectional view taken along line 8-8 of FIG. 6 and showing interior features of the heat exchange device of FIG. 4, including a thin slit section of the fluid passageway.

Referring to FIG. 8, features of the thin slit section 146 are further described. FIG. 8 shows a cross sectional view transverse to the fluid flow direction in the fluid passageway 140. The block 158 is positioned between, and spaced from, the first and second outer walls 154, 156. The first leg 172 of the thin slit section 146 is defined between the first outer wall 154 and the outer surface 160 of the block 158. The second leg 174 of the thin slit section 146 is defined between the second outer wall 156 and the outer surface 162 of the block 158.

FIG. 8 also shows that the first and second legs 172, 174 of the thin slit section 146 have profiles transverse to the fluid flow direction having quadrilateral shapes. The quadrilateral shapes are generally similar and are characterized by first dimensions 192, which are widths of the quadrilaterals and second dimensions 194, which are thicknesses of the quadrilaterals. The widths 192 of the quadrilateral shapes are substantially greater than the thicknesses 194. In addition, the thin slit section length 152 is substantially greater than the thicknesses 194.

Figure 9:
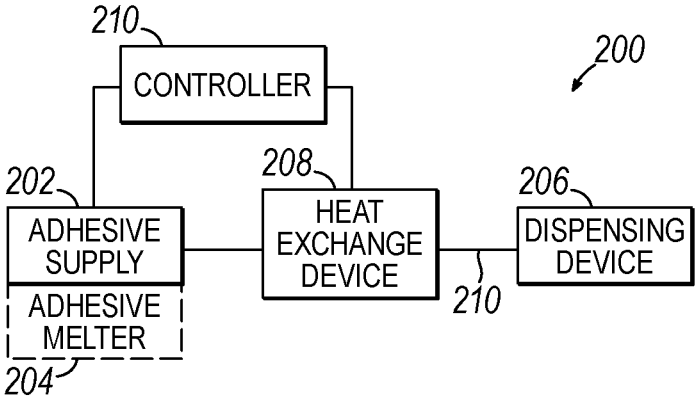
FIG. 9 is a schematic depiction of a liquid adhesive system according to a further embodiment of the invention.
Figure 10:
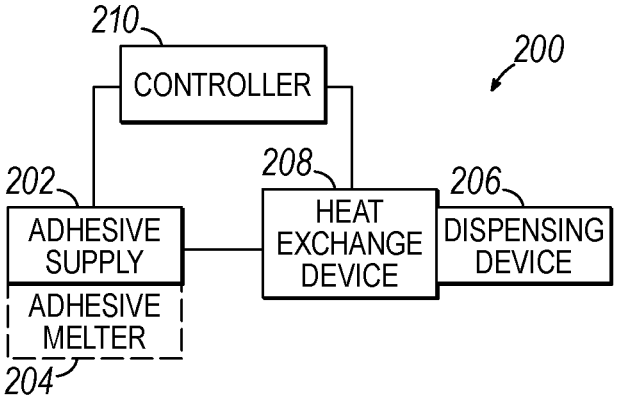
FIG. 10 is a schematic depiction of a liquid adhesive system according to a further embodiment of the invention.

Referring next to FIGS. 9 and 10, liquid adhesive systems 200 generally include an adhesive supply 202, a dispensing device 206, and a heat exchange device 208. The liquid adhesive systems 200 optionally can include an adhesive melter 204, as shown.

The adhesive supply 202 is configured to provide a supply of liquid adhesive material for dispensing by the dispensing device 206. The adhesive melter 204, if present, can be part of the adhesive supply 202, and is configured to melt solid or semi-solid unmelted hot melt adhesive material to form a liquid adhesive material.

The dispensing device 206 is coupled with the adhesive supply 202 through the heat exchange device 208 and is configured for dispensing the liquid adhesive material in an adhesive bonding application. In particular, the heat exchange device 208 is coupled with the adhesive supply 202 (or the adhesive melter 204, as appropriate) and the dispensing device 206. The heat exchange device 208 is configured for heating the liquid adhesive material to an application temperature suitable for the adhesive bonding application. The heat exchange device 208 can be like either of the heat exchange devices 10, 112 discussed above, for example.

If the heat exchange device 208 is like the heat exchange device 10, a heated hose 210 extends between the outlet of the heat exchange device 208 and an inlet of the dispensing device 206, such that liquid adhesive material flows through the heated hose 210 from the heat exchange device 208 to the dispensing device 206, as shown in FIG. 9.

If the heat exchange device 208 is like the heat exchange device 112, the outlet of the heat exchange device 208 is coupled directly with an inlet of the dispensing device 206, such that liquid adhesive material is provided directly from the heat exchange device 208 to the dispensing device 206, as shown in FIG. 10.

The liquid adhesive systems 200 can also include a controller 210. As shown, the controller 210 is operatively coupled with the adhesive supply 202 and the heat exchange device 208. If an adhesive melter 204 is included, the controller 210 can be operatively coupled with the adhesive melter 204. The controller 210 is configured to operate the heat exchange device 208 so as to heat the liquid adhesive material to the application temperature. The controller 210 is also configured to operate the adhesive supply 202 (and the adhesive melter 204, as appropriate) to maintain the liquid adhesive material at a temperature below the application temperature, such that the liquid adhesive material is not suitable for the adhesive bonding application before it is heated to the application temperature in the heat exchange device 208. While controller 210 is depicted as a single controller, it will be appreciated that the controller 210 could include multiple controllers for the adhesive supply 202, the heat exchange device 208, and the adhesive melter 204 for controlling the same as described herein.

In use, the hot melt adhesive systems 200 provide for dispensing liquid adhesive material for an adhesive bonding application. In some embodiments, a supply of solid or semi-solid unmelted hot melt adhesive material is melted by the adhesive melter 204 to form a liquid adhesive material. In these or other embodiments, the supply of solid or semi-solid unmelted hot melt adhesive material may be heated at a temperature less than the application temperature, such as less than 300° F.

The liquid adhesive material is directed from the adhesive supply 202 (or the adhesive melter 204) to the heat exchange device 208. The liquid adhesive material is directed through a thin slit section (28, 146) of a fluid passageway (22, 140) in the heat exchange device 208 (which again, can be like either of the heat exchange devices 10, 112). The liquid adhesive material in the fluid passageway (22, 140) is heated to an application temperature. In some embodiments, especially for liquid adhesive materials created by melting a supply of solid or semi-solid unmelted hot melt adhesive material, the application temperature may be greater than 350° F.

The liquid adhesive material is then directed from the heat exchange device 208 to the dispensing device 206. The dispensing device 206 is then used to dispense the liquid adhesive material for an adhesive bonding application.

If the heat exchange device 208 is like the heat exchange device 10, the liquid adhesive material is directed through the heated hose 210 between the heat exchange device 208 and the dispensing device 206.

The liquid adhesive material at the application temperature is suitable for the adhesive bonding application. The liquid adhesive material is maintained at temperatures below the application temperature, however, before the liquid adhesive material is heated to the application temperature in the heat exchange device 208. Thereby, the liquid adhesive material is not suitable for the adhesive bonding application before it is heated to the application temperature in the heat exchange device. And as discussed above, a controller, such as the controller 210, can be operated to operate the heat exchange device 208 and the adhesive supply 202 (and the adhesive melter 204, if included) such that the liquid adhesive material is heated to the application temperature in the heat exchange device 208, but is maintained at a temperature below the application temperature before it reaches the heat exchange device 208.

Advantageously, by maintaining the liquid adhesive material below the application temperature until it reaches a heat exchange device as disclosed herein, the degradation effects caused by high temperatures on the liquid adhesive material may be avoided. In addition, energy can be conserved by operating the components of the hot melt adhesive system upstream from the heat exchange device (such as the adhesive supply or the adhesive melter) at lower temperatures. Further still, by using thin slit sections in fluid passageways, the heat exchange devices evenly and thoroughly heat the liquid adhesive material flowing through them.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A heat exchange device for heating liquid adhesive material to an application temperature suitable for an adhesive bonding application, the heat exchange device comprising:

a body having an inlet configured to receive a flow of liquid adhesive material and an outlet configured to provide the liquid adhesive material to a dispensing device for the adhesive bonding application, a fluid passageway defined in the body connecting the inlet and the outlet and configured to receive the flow of liquid adhesive material, the fluid passageway including a thin slit section to provide a large contact surface area of the body with a relatively small volume of liquid adhesive material, the thin slit section having at least a first portion and a second portion generally parallel to the first portion, the first portion having a first flow direction and a first length along the first flow direction, the second portion having a second flow direction opposite the first flow direction and a second length along the second flow direction, the first and second portions each further having first and second dimensions transverse to the respective first and second fluid flow directions, the respective first dimensions and the respective first and second lengths being substantially greater than the respective second dimensions, and a heating element thermally coupled with the body and configured to heat the liquid adhesive material flowing through the thin slit section to the application temperature.

2. The heat exchange device of claim 1, wherein the first and second portions of the thin slit section each have a concentrically shaped profile transverse to the first and second flow directions, and the first portion is generally radially inside the second portion.

3. The heat exchange device of claim 1, wherein the fluid passageway comprises an inlet section between the inlet and the thin slit section and an outlet section between the thin slit section and the outlet, the inlet section and the outlet section having lengths along the fluid flow direction and profiles transverse to the fluid flow direction having third dimensions and fourth dimensions, the third dimensions being substantially equal to the fourth dimensions.

4. The heat exchange device of claim 1, further comprising:

a temperature sensor coupled with the body for measuring the temperature of the liquid adhesive material flowing through the fluid passageway.

5. The heat exchange device of claim 4, wherein the temperature sensor is closer to the fluid passageway than to the heating element.

6. The heat exchange device of claim 4, wherein the shortest distance from the temperature sensor to the fluid passageway is less than 1/10 of the total length of the fluid passageway.

7. The heat exchange device of claim 4, wherein the temperature sensor is positioned at a location where the amount of time it takes the liquid adhesive material to flow from that location to the outlet is approximately equal to the amount of time it takes the heat exchange device to change the temperature of the liquid adhesive material flowing in the fluid passageway to the desired temperature.

8. The heat exchange device of claim 1, wherein the profile of the thin slit section is a ring, the first dimension is a circumference of the ring, and the second dimension is a radial thickness of the ring, wherein the body is comprised of generally concentrically arranged first, second, and third body segments, the second body segment being generally radially inside the first body segment and the third body segment being generally radially inside the second body segment, and wherein the thin slit section of the fluid passageway is defined between the first and second body segments.

9. The heat exchange device of claim 8, wherein the inlet is in the third body segment and the outlet is in the second body segment.

10. The heat exchange device of claim 8, wherein the thin slit section is further defined between the second and third body segments.

11. The heat exchange device of claim 8, wherein the heating element is positioned in a socket in the first body segment.

12. The heat exchange device of claim 1, wherein the profile of the thin slit section is a quadrilateral, the first dimension is a width of the quadrilateral, and the second dimension is a thickness of the quadrilateral.

13. The heat exchange device of claim 12, wherein the body is comprised of first and second generally opposed outer walls and a block positioned between and spaced from the first and second outer walls, and wherein the thin slit section of the fluid passageway is defined between the block and at least one of the first and second outer walls.

14. The heat exchange device of claim 13, wherein the body is further comprised of a head opposed from a base with the block positioned generally there between, and wherein the inlet is in the head and the outlet is in the base.

15. The heat exchange device of claim 13, wherein the thin slit section of the fluid passageway is defined between the block and both of the first and second outer walls.

16. The heat exchange device of claim 13, wherein the heating element is positioned in a socket in the block.

17. The heat exchange device of claim 13, further comprising:

a filter coupled with the fluid passageway for filtering the liquid adhesive material before it exits the outlet.

18. A method of dispensing liquid adhesive material for an adhesive bonding application, the method comprising:

directing liquid adhesive material from an adhesive supply to a heat exchange device and through a fluid passageway in the heat exchange device, wherein the fluid passageway includes a thin slit section to provide a large contact surface area of a body of the device with a relatively small volume of liquid adhesive material, the thin slit section having at least a first portion and a second portion generally parallel to the first portion, the first portion having a first flow direction and a first length along the first flow direction, the second portion having a second flow direction opposite the first flow direction and a second length along the second flow direction, the first and second portions each further having first and second dimensions transverse to the respective first and second fluid flow directions, the respective first dimensions and the respective first and second lengths being substantially greater than the respective second dimensions, heating the liquid adhesive material in the fluid passageway of the heat exchange device to an application temperature suitable for the adhesive bonding application, the liquid adhesive material being maintained at temperatures below the application temperature before it is heated in the heat exchange device such that the liquid adhesive material is not suitable for the adhesive bonding application before it is heated to the application temperature in the heat exchange device, directing the liquid adhesive material from the heat exchange device to a dispensing device, and dispensing the liquid adhesive material using the dispensing device.

19. The method of claim 18, wherein the application temperature is greater than 350° F.

20. The method of claim 18, further comprising melting a supply of solid or semi-solid unmelted hot melt adhesive material to form the liquid adhesive material before directing liquid adhesive material from an adhesive supply to a heat exchange device.

21. The method of claim 20, wherein melting a supply of solid or semi-solid unmelted hot melt adhesive material includes heating the solid or semi-solid unmelted hot melt adhesive material at a temperature less than 300° F.

22. The method of claim 18, further comprising:

operating a controller to operate the heat exchange device so as to heat the liquid adhesive material to the application temperature, and operating the controller to operate the adhesive supply to maintain the liquid adhesive material at a temperature below the application temperature.

23. A heat exchange device for heating liquid adhesive material to an application temperature suitable for an adhesive bonding application, the heat exchange device comprising:

a body having an inlet configured to receive a flow of liquid adhesive material and an outlet configured to provide the liquid adhesive material to a dispensing device for the adhesive bonding application, a fluid passageway defined in the body connecting the inlet and the outlet and configured to receive the flow of liquid adhesive material, the fluid passageway including an inlet section having a first flow direction, an outlet section having a second flow direction, and a first thin slit section fluidly connecting the inlet section and the outlet section and having a third flow direction and a length along the third flow direction, the first flow direction of the inlet section and the second flow direction of the outlet section being parallel to one another, the third flow direction of the first thin slit section being perpendicular to both the first flow direction of the inlet section and the second flow direction of the outlet section, the first thin slit section having a profile transverse to the third flow direction and with a first dimension and a second dimension, the first dimension of the profile of the first thin slit section and the length of the first thin slit section both being substantially greater than the second dimension of the profile of the first thin slit section, and a heating element thermally coupled with the body and configured to heat the liquid adhesive material flowing through the thin slit section to the application temperature.

24. The heat exchange device of claim 23, wherein the fluid passageway further includes a second thin slit section connecting the inlet section and the outlet section and having a fourth flow direction and a length along the fourth flow direction, the fourth flow direction of the second thin slit section being parallel to the third flow direction of the first thin slit section, the second thin slit section having a profile transverse to the fourth flow direction and with a first dimension and a second dimension, the first dimension of the profile of the second thin slit section and the length of the first thin slit section both being substantially greater than the second dimension of the second thin slit section.

25. The heat exchange device of claim 24, wherein the heating element is positioned within the body between the first thin slit section and the second thin slit section.

* * * * *